US011405996B1

(12) United States Patent
Suich et al.

(10) Patent No.: US 11,405,996 B1
(45) Date of Patent: Aug. 2, 2022

(54) HIGH POWER LIGHT-EMITTING DIODE ARRAYS AND RELATED DEVICES

(71) Applicant: CreeLED, Inc., Durham, NC (US)

(72) Inventors: David Suich, Durham, NC (US); Casey Lapoint, Chapel Hill, NC (US); Guy Pickett, Durham, NC (US)

(73) Assignee: CreeLED, Inc., Durham, NC (US)

( * ) Notice: Subject to any disclaimer, the term of this patent is extended or adjusted under 35 U.S.C. 154(b) by 0 days.

(21) Appl. No.: 17/383,923

(22) Filed: Jul. 23, 2021

(51) Int. Cl.
*H05B 45/40* (2020.01)
*H05B 45/10* (2020.01)

(52) U.S. Cl.
CPC ..... *H05B 45/40* (2020.01); *H05B 45/10* (2020.01)

(58) Field of Classification Search
CPC .... H05B 45/48; H05B 45/46; H05B 45/3725; H05B 45/50; H05B 45/56; H05B 45/20; H05B 45/36; H05B 45/44; H05B 41/245; H05B 45/10; H05B 45/395; H05B 45/37; H05B 45/385; H05B 45/325; H05B 47/115; H05B 45/18; H05B 45/355; H05B 45/40; H05B 47/10; H05B 45/375; H05B 45/382; H05B 45/397; H05B 45/60; H05B 47/16; H05B 47/18; H05B 3/342; H05B 45/24; H05B 45/305; H05B 45/335; H05B 45/38; H05B 45/39; H05B 2203/036; H05B 3/34; H05B 31/50; H05B 45/12; H05B 45/14; H05B 45/28; H05B 45/35; H05B 47/175; H05B 47/185; H05B 45/3578; H05B 47/00; H05B 47/105; H05B 47/11; H05B 47/155; H05B 47/19; H01L 28/40; H01L 29/0657; H01L 29/7841; H01L 2924/207; H01L 31/022475; H01L 31/072; H01L 33/64; H01L 49/00; H01L 49/006; H01L 21/3065; H01L 21/3081; H01L 21/31127; H01L 21/485; H01L 21/67109; H01L 21/6719; H01L 21/67207; H01L 21/6833;
(Continued)

(56) References Cited

U.S. PATENT DOCUMENTS 8,328,405 B2 12/2012 Negley
8,742,671 B2 6/2014 van de Ven et al.
(Continued)

*Primary Examiner* — Monica C King
(74) *Attorney, Agent, or Firm* — Withrow & Terranova, P.L.L.C.

(57) ABSTRACT

Light-emitting diode (LED) arrays, and more particularly high power LED arrays and related devices are disclosed. Exemplary lighting devices with arrangements of LED chips and/or lumiphoric materials are capable of dynamically providing different color points and/or light outputs. Devices include individually controllable LED chips arranged on a common submount that may include integrated control circuitry for controlling operation of the LED chips. LED chips may be arranged to form sub-arrays of like-colored LED chips and corresponding electrical connections may include one or more shared electrical contacts. Certain aspects relate to arrangements where electrical connections are provided on opposite faces of submounts from the LED chips such that an increased density of LED chips may be arranged along primary emission faces. Applications for such high-power LED arrays and related devices include various color-changing lighting fixtures with high light output that may benefit from dynamic spectral tuning with improved precision.

24 Claims, 8 Drawing Sheets

(58) Field of Classification Search
CPC ..... H01L 21/8238; H01L 22/22; H01L 2221/68363; H01L 2223/6677; H01L 2224/1161; H01L 2224/12105; H01L 2224/1319; H01L 2224/14131; H01L 2224/14132; H01L 2224/14135; H01L 2224/14151; H01L 27/14663; H01L 31/0324; H01L 2224/14152; H01L 2224/14155; H01L 2224/16; H01L 2224/16227; H01L 2224/16235; H01L 2224/48195; H01L 2224/49176; H01L 2224/73267; H01L 2224/81001; H01L 2224/81191; H01L 2224/81203; H01L 2224/81207; H01L 2224/81815; H01L 2224/8185; H01L 2225/06513; H01L 2225/06517; H01L 23/13; H01L 23/36; H01L 23/4855; H01L 23/49816; H01L 23/50; H01L 23/5252; H01L 23/5254; H01L 23/5286; H01L 23/5328; H01L 23/535; H01L 23/5383; H01L 23/5386; H01L 23/5389; H01L 23/552; H01L 23/642; H01L 23/645; H01L 24/14; H01L 24/20; H01L 24/49; H01L 24/81; H01L 25/04; H01L 25/16; H01L 27/105; H01L 27/1052; H01L 27/10826; H01L 27/10873; H01L 27/10876; H01L 27/11; H01L 27/112; H01L 27/11206; H01L 27/11529; H01L 27/11582; H01L 27/11807; H01L 27/14665; H01L 27/156; H01L 27/2463; H01L 27/307; H01L 29/1033; H01L 29/42392; H01L 29/66545; H01L 29/66795; H01L 29/66825; H01L 29/66833; H01L 29/7881; H01L 29/792; H01L 2924/00015; H01L 2924/01019; H01L 2924/01066; H01L 2924/09701; H01L 2924/12044; H01L 2924/14; H01L 2924/1421; H01L 2924/1433; H01L 2924/1436; H01L 2924/1437; H01L 2924/19105; H01L 2924/19107; H01L 2924/3512; H01L 31/022408; H01L 31/022416; H01L 31/03529; H01L 33/486; H01L 35/02; H01L 35/34; H01L 45/1206; H01L 45/1616; H01L 45/1683; H01L 51/0036; H01L 51/4253; H01L 27/14603; H01L 27/14601; H01L 27/14609; H01L 31/036; H01L 27/14687; H01L 31/1013; H01L 27/14641; H01L 27/14647; H01L 27/14652; H01L 27/14692; H01L 2924/00; H01L 2924/00014; H01L 2924/13091; H01L 27/14625; H01L 2924/181; H01L 2924/00012; H01L 21/78; H01L 2221/68327; H01L 21/6835; H01L 21/6836; H01L 2221/68381; H01L 21/82; H01L 2221/6834; H01L 31/0232; H01L 2224/13111; H01L 2224/13113; H01L 2224/13116; H01L 2224/13124; H01L 2224/13144; H01L 2224/13147; H01L 2224/48091; H01L 23/481; H01L 23/544; H01L 24/13; H01L 2924/12042; H01L 2224/0401; H01L 24/11; H01L 27/0688; H01L 2924/01322; H01L 2924/1461; H01L 2924/3025; H01L 2224/11; H01L 2224/1132; H01L 2224/11334; H01L 2224/13139; H01L 2224/94; H01L 24/94; H01L 27/092; H01L 27/14621; H01L 27/14627; H01L 27/14645; H01L 2924/01082; H01L 2924/12041; H01L 2924/1305; H01L 2924/3011; H01L 31/02162; H01L 31/09; H01L 2224/16225; H01L 2224/32225; H01L 2224/48247; H01L 2224/73204; H01L 2224/73265; H01L 25/167; H01L 27/14656; H01L 27/14843; H01L 27/1485; H01L 2924/10253; H01L 2924/15311; H01L 31/035218; H01L 21/76254; H01L 21/84; H01L 2221/68354; H01L 2223/5442; H01L 2223/54426; H01L 2223/54453; H01L 2223/5446; H01L 2224/03; H01L 2224/0345; H01L 2224/03452; H01L 2224/0346; H01L 2224/05552; H01L 2224/0557; H01L 2224/05571; H01L 2224/05611; H01L 2224/05624; H01L 2224/05639; H01L 2224/05644; H01L 2224/05647; H01L 2224/1146; H01L 2224/13023; H01L 2224/13025; H01L 2224/13109; H01L 2224/13155; H01L 2224/48227; H01L 2224/81; H01L 2224/81805; H01L 2224/81903; H01L 2224/83; H01L 2224/83851; H01L 2224/9211; H01L 25/0753; H01L 27/0207; H01L 27/0694; H01L 27/088; H01L 27/1108; H01L 27/1203; H01L 27/1443; H01L 27/14676; H01L 27/14678; H01L 29/785; H01L 29/78696; H01L 2924/00011; H01L 2924/0105; H01L 2924/12032; H01L 2924/1306; H01L 2924/13062; H01L 31/1085; H01L 2224/131; H01L 2224/16145; H01L 2224/32145; H01L 2225/06527; H01L 2225/06541; H01L 2225/06589; H01L 23/53285; H01L 23/66; H01L 24/16; H01L 24/32; H01L 24/48; H01L 25/0657; H01L 27/10802; H01L 27/10897; H01L 27/11524; H01L 27/11578; H01L 27/1446; H01L 27/14612; H01L 27/14629; H01L 27/1463; H01L 27/14634; H01L 27/14636; H01L 27/14643; H01L 27/14681; H01L 27/2436; H01L 27/249; H01L 29/161; H01L 2924/0002; H01L 2924/01015; H01L 2924/01047; H01L 2924/014; H01L 2924/10329; H01L 2924/30107; H01L 31/02; H01L 31/02016; H01L 31/0224; H01L 31/02325; H01L 31/02327; H01L 31/0236; H01L 31/02363; H01L 31/02366; H01L 31/028; H01L 31/0352; H01L 31/035281; H01L 31/075; H01L 31/077; H01L 31/103; H01L 31/1037; H01L 31/105; H01L 31/107; H01L 31/1075; H01L 31/1804; H01L 31/1808; H01L 33/62; H01L 39/126; H01L 39/128; H01L 39/143; H01L 39/225; H01L 45/04; H01L 45/1226; H01L 45/146; H01L 21/561; H01L 21/568; H01L 21/8221; H01L 21/823475; H01L 21/845; H01L 2221/68336; H01L 2221/6835; H01L 2223/6627; H01L 2224/05599; H01L 2224/1134; H01L 2224/1145; H01L 2224/11462; H01L 2224/11464; H01L 2224/11849; H01L 2224/11901; H01L 2224/13022; H01L 2224/45015; H01L 2224/45099; H01L 23/3114; H01L 23/3171; H01L 23/3677; H01L 23/52; H01L 23/5225; H01L 25/0655; H01L 25/18; H01L 27/0886; H01L 27/0922; H01L 27/10894; H01L 27/1104; H01L 27/1116; H01L 27/11526; H01L 27/11551; H01L 27/1157; H01L 27/11573; H01L 27/11803; H01L 27/1207; H01L 27/1225; H01L 27/124; H01L 27/14623; H01L 27/14632; H01L 27/14638; H01L 27/14887

See application file for complete search history.

(56) References Cited

U.S. PATENT DOCUMENTS

| | | | | |
|---|---|---|---|---|
| 10,312,224 | B2 | 6/2019 | Edmond et al. | |
| 2018/0112837 | A1* | 4/2018 | Sadwick | H05B 47/105 |
| 2018/0279429 | A1* | 9/2018 | Sadwick | H05B 45/3725 |
| 2020/0312220 | A1* | 10/2020 | Hussell | F21V 23/06 |
| 2020/0312222 | A1 | 10/2020 | Hussell | |
| 2020/0312225 | A1 | 10/2020 | Hussell | |
| 2020/0312226 | A1* | 10/2020 | Hussell | G09G 3/3426 |
| 2020/0312231 | A1* | 10/2020 | Hussell | G09G 3/2096 |
| 2021/0043821 | A1* | 2/2021 | Hussell | H05B 45/325 |

* cited by examiner

HIGH POWER LIGHT-EMITTING DIODE ARRAYS AND RELATED DEVICES

FIELD OF THE DISCLOSURE

The present disclosure relates to light emitting diode arrays, and more particularly to high power light emitting diode arrays and related devices.

BACKGROUND

Solid-state lighting devices such as light-emitting diodes (LEDs) are increasingly used in both consumer and commercial applications. Advancements in LED technology have resulted in highly efficient and mechanically robust light sources with a long service life. Accordingly, modern LEDs have been widely adopted in various illumination contexts, for backlighting of liquid crystal display (LCD) systems (e.g., as a substitute for cold cathode fluorescent lamps), and for direct-view LED displays. Applications utilizing LED arrays further include vehicular headlamps, roadway illumination, light fixtures, and various indoor, outdoor, and specialty contexts. Desirable characteristics of LED devices include high luminous efficacy, long lifetime, and color gamut.

LEDs convert electrical energy to light and generally include one or more active layers of semiconductor material (or an active region) arranged between oppositely doped n-type and p-type layers. When a bias is applied across the doped layers, holes and electrons are injected into the one or more active layers where they recombine to generate emissions such as visible light or ultraviolet emissions. An LED chip typically includes an active region that may be fabricated, for example, from silicon carbide, gallium nitride, gallium phosphide, aluminum nitride, gallium arsenide-based materials, and/or from organic semiconductor materials. Photons generated by the active region are initiated in all directions.

Typically, it is desirable to operate LEDs at the highest light emission efficiency possible, which can be measured by the emission intensity in relation to the output power (e.g., in lumens per watt). A practical goal to enhance emission efficiency is to maximize extraction of light in the direction of the desired transmission of light. Light extraction and external quantum efficiency of an LED can be limited by a number of factors, including internal reflection and/or absorption. LED packages have been developed that can provide mechanical support, electrical connections, and encapsulation for LED emitters. Light emissions that exit surfaces of LED emitters may then interact with elements or surfaces of corresponding LED packages, thereby increasing opportunities for reflections and/or light loss. Multiple color LED packages have been developed that include different colored LED chips arranged within a same package structure. In certain applications, the different colored LED chips can be arranged in close proximity to one another on a common submount, which can add complexity for corresponding electrical connections. As LED applications continue to advance, challenges exist in producing high quality light with desired emission characteristics while also providing high light emission efficiency.

The art continues to seek improved LEDs and solid-state lighting devices having desirable illumination characteristics capable of overcoming challenges associated with conventional lighting devices.

SUMMARY

Aspects disclosed herein relate to light-emitting diode (LED) arrays, and more particularly to high power LED arrays and related devices. Exemplary lighting devices with arrangements of LED chips and/or lumiphoric materials are capable of dynamically providing different color points and/or light outputs. Devices are disclosed where individually controllable LED chips are arranged on a common submount that may include integrated control circuitry, such as an application-specific integrated circuit (ASIC), for controlling operation of the LED chips. The LED chips may be arranged to form sub-arrays of like-colored LED chips and corresponding electrical connections may include one or more shared electrical contacts. Certain aspects relate to arrangements where electrical connections are provided on opposite faces of submounts from the LED chips such that an increased density of LED chips may be arranged along primary emission faces of corresponding lighting devices. Applications for such high-power LED arrays and related devices include various color-changing lighting fixtures with high light output that may benefit from dynamic spectral tuning with improved precision.

In one aspect, a lighting device comprises: a submount comprising a primary emission face, a primary mounting face that is opposite the primary emission face, and an ASIC; and a plurality of LED chips on the primary emission face, wherein the ASIC is arranged between the plurality of LED chips and the primary mounting face, and the ASIC is configured to provide control signals to the plurality of LED chips; wherein the plurality of LED chips comprises a first group of LED chips configured to provide a first peak wavelength, a second group of LED chips configured to provide a second peak wavelength that is different than the first peak wavelength, and a third group of LED chips configured to provide a third peak wavelength that is different than both the first peak wavelength and the second peak wavelength; and wherein each of the first group of LED chips, the second group of LED chips, and the third group of LED chips forms discrete sub-arrays on the submount.

The lighting device may further comprise a plurality of contact pads that is arranged to receive external electrical connections. In certain embodiments, the plurality of contact pads is arranged on the primary emission face. In certain embodiments, the plurality of contact pads is arranged on the primary mounting face. In certain embodiments, the plurality of contact pads is arranged to cover at least 75% of the primary mounting face. The lighting device may further comprise a plurality of electrically conductive vias that is provided between the plurality of contact pads and the primary emission face. In certain embodiments, the plurality of contact pads comprises: a first contact pad that is electrically coupled to the first group of LED chips; a second contact pad that is electrically coupled to the second group of LED chips; a third contact pad that is electrically coupled to the third group of LED chips; and a fourth contact pad that is electrically coupled to each of the first, second, and third groups of LED chips. In certain embodiments, the plurality of contact pads comprises: a first contact pad that is electrically coupled to provide power signals to each of the first, second, and third groups of LED chips; a second contact pad that is electrically coupled to provide power signals to each of the first, second, and third groups of LED chips; and one or more additional contact pads that are configured to receive data signals for the ASIC.

The lighting device may further comprise a plurality of circuit layers that provides electrical connections between the ASIC and the plurality of LED chips at the primary emission face. The lighting device may further comprise a light-altering material that is on the plurality of circuit layers, wherein the light-altering material is arranged to extend to a height that at least partially covers sidewalls of the plurality of LED chips. The lighting device may further comprise a plurality of switching devices that is configured to selectively activate and deactivate individual LED chips of the plurality of LED chips. In certain embodiments, the ASIC is configured to provide signals for selectively dimming individual ones of the plurality of LED chips.

In certain embodiments, the first peak wavelength, the second peak wavelength, and the third peak wavelength differ from one another by at least 20 nanometers (nm). In certain embodiments, each LED chip of the plurality of LED chips comprises a same epitaxial material type, and one or more of the first group of LED chips, the second group of LED chips, and the third group of LED chips further comprises a lumiphoric material. In certain embodiments, at least one of the first group of LED chips, the second group of LED chips, and the third group of LED chips comprises a different epitaxial material type than others of the first group of LED chips, the second group of LED chips, and the third group of LED chips. In certain embodiments, a lateral dimension of each LED chip of the plurality of LED chips is in a range from 500 microns (μm) to 2000 μm. In other embodiments, a lateral dimension of each LED chip of the plurality of LED chips is in a range from 50 μm to 300 μm.

In another aspect, a lighting device comprises: a submount comprising a primary emission face, a primary mounting face that is opposite the primary emission face, and an ASIC; a plurality of LED chips on the primary emission face, wherein the ASIC is arranged between the plurality of LED chips and the primary mounting face, and the ASIC is configured to provide control signals to the plurality of LED chips; and a plurality of switching devices that is associated with the ASIC, wherein the plurality of switching devices is arranged below the primary emission face of the submount, wherein individual switching devices of the plurality of switching devices are configured to selectively activate and deactivate individual LED chips of the plurality of LED chips. In certain embodiments, each switching device of the plurality of switching devices is registered with an individual LED chip of the plurality of LED chips. The lighting device may further comprise: a first contact pad that is electrically coupled to provide power signals to each of the first, second, and third groups of LED chips; a second contact pad that is electrically coupled to provide power signals to each of the first, second, and third groups of LED chips; one or more additional contact pads that are configured to receive data signals for the ASIC. In certain embodiments, at least a portion of the data signals controls operation of the plurality of switching devices. In certain embodiments, the first contact pad, the second contact pad, and the one or more additional contact pads are arranged on the primary mounting face. In certain embodiments, the plurality of LED chips comprises: a first group of LED chips configured to provide a first peak wavelength; a second group of LED chips configured to provide a second peak wavelength that is different than the first peak wavelength; and a third group of LED chips configured to provide a third peak wavelength that is different than both the first peak wavelength and the second peak wavelength; wherein each of the first group of LED chips, the second group of LED chips, and the third group of LED chips forms discrete sub-arrays on the submount. In certain embodiments, the plurality of switching devices comprises at least one of a field-effect transistor (FET), a metal-oxide-semiconductor field-effect transistor (MOSFET), and an insulated-gate bipolar transistor (IGBT).

In another aspect, any of the foregoing aspects individually or together, and/or various separate aspects and features as described herein, may be combined for additional advantage. Any of the various features and elements as disclosed herein may be combined with one or more other disclosed features and elements unless indicated to the contrary herein.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
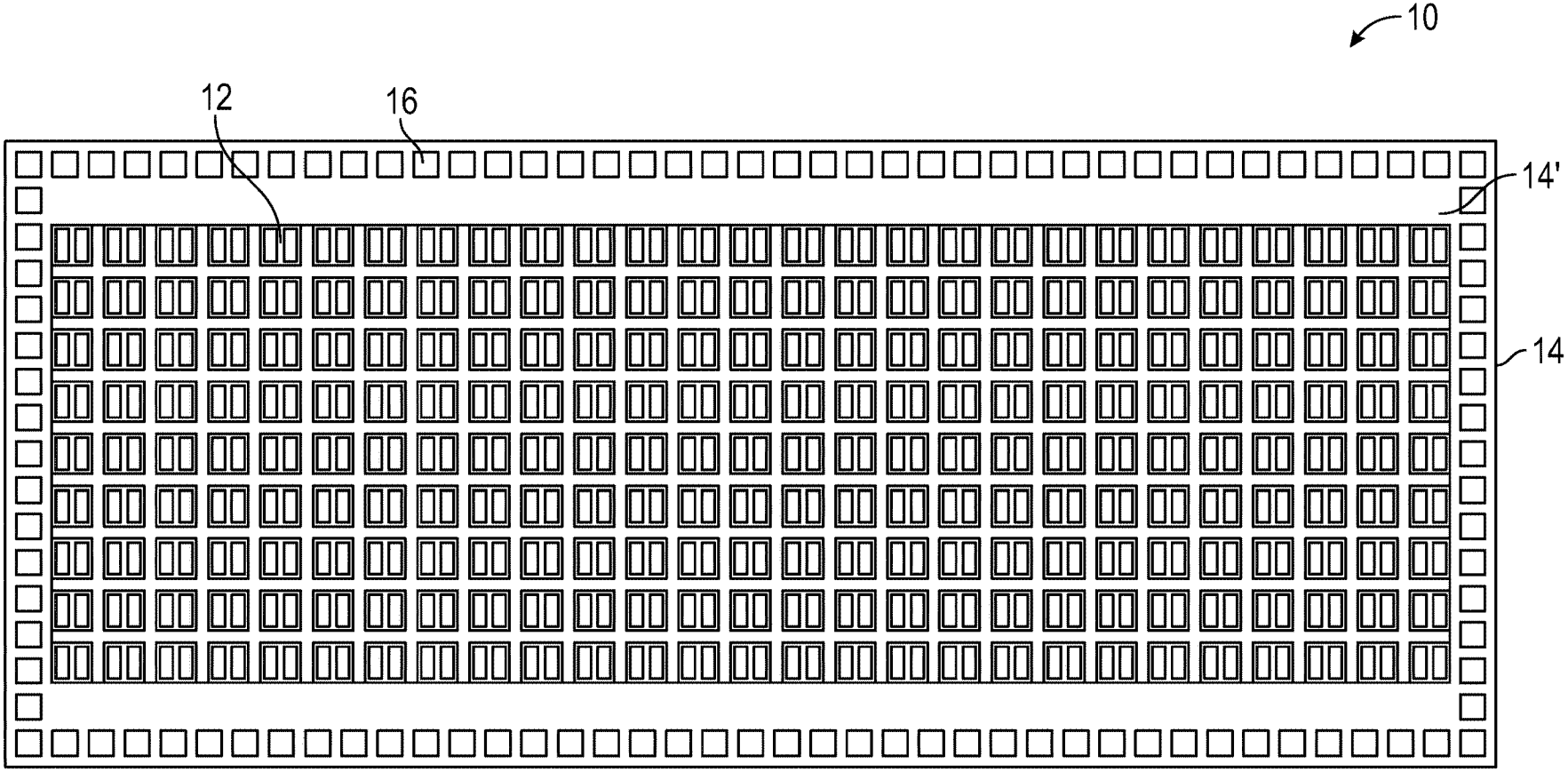
FIG. 1 is a top view of an exemplary lighting device that includes a plurality of light-emitting diode (LED) chips arranged to form an LED array on a common submount according to principles of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments are described herein with reference to schematic illustrations of embodiments of the disclosure. As such, the actual dimensions of the layers and elements can be different, and variations from the shapes of the illustrations as a result, for example, of manufacturing techniques and/or tolerances, are expected. For example, a region illustrated or described as square or rectangular can have rounded or curved features, and regions shown as straight lines may have some irregularity. Thus, the regions illustrated in the figures are schematic and their shapes are not intended to illustrate the precise shape of a region of a device and are not intended to limit the scope of the disclosure. Additionally, sizes of structures or regions may be exaggerated relative to other structures or regions for illustrative purposes and, thus, are provided to illustrate the general structures of the present subject matter and may or may not be drawn to scale. Common elements between figures may be shown herein with common element numbers and may not be subsequently re-described.

Aspects disclosed herein relate to light-emitting diode (LED) arrays, and more particularly to high power LED arrays and related devices. Exemplary lighting devices with arrangements of LED chips and/or lumiphoric materials are capable of dynamically providing different color points and/or light outputs. Devices are disclosed where individually controllable LED chips are arranged on a common submount that may include integrated control circuitry, such as an application-specific integrated circuit (ASIC), for controlling operation of the LED chips. The LED chips may be arranged to form sub-arrays of like-colored LED chips and corresponding electrical connections may include one or more shared electrical contacts. Certain aspects relate to arrangements where electrical connections are provided on opposite faces of submounts from the LED chips such that an increased density of LED chips may be arranged along primary emission faces of corresponding lighting devices. Applications for such high-power LED arrays and related devices include various color-changing lighting fixtures with high light output that may benefit from dynamic spectral tuning with improved precision.

Before delving into specific details of various aspects of the present disclosure, an overview of various elements that may be included in exemplary LED packages of the present disclosure is provided for context. An LED chip typically comprises an active LED structure or region that can have many different semiconductor layers arranged in different ways. The fabrication and operation of LEDs and their active structures are generally known in the art and are only briefly discussed herein. The layers of the active LED structure can be fabricated using known processes with a suitable process being fabrication using metal organic chemical vapor deposition. The layers of the active LED structure can comprise many different layers and generally comprise an active layer sandwiched between n-type and p-type oppositely doped epitaxial layers, all of which are formed successively on a growth substrate. It is understood that additional layers and elements can also be included in the active LED structure, including, but not limited to, buffer layers, nucleation layers, super lattice structures, undoped layers, cladding layers, contact layers, and current-spreading layers and light extraction layers and elements. The active layer can comprise a single quantum well, a multiple quantum well, a double heterostructure, or super lattice structures.

The active LED structure can be fabricated from different material systems, with some material systems being Group III nitride-based material systems. Group III nitrides refer to those semiconductor compounds formed between nitrogen (N) and the elements in Group III of the periodic table, usually aluminum (Al), gallium (Ga), and indium (In). Gallium nitride (GaN) is a common binary compound. Group III nitrides also refer to ternary and quaternary compounds such as aluminum gallium nitride (AlGaN), indium gallium nitride (InGaN), and aluminum indium gallium nitride (AlInGaN). For Group III nitrides, silicon (Si) is a common n-type dopant and magnesium (Mg) is a common p-type dopant. Accordingly, the active layer, n-type layer, and p-type layer may include one or more layers of GaN, AlGaN, InGaN, and AlInGaN that are either undoped or doped with Si or Mg for a material system based on Group III nitrides. Other material systems include silicon carbide (SiC), organic semiconductor materials, and other Group III-V systems such as gallium phosphide (GaP), gallium arsenide (GaAs), and related compounds.

The active LED structure may be grown on a growth substrate that can include many materials, such as sapphire, SiC, aluminum nitride (AlN), and GaN, with a suitable substrate being a 4H polytype of SiC, although other SiC polytypes can also be used including 3C, 6H, and 15R polytypes. SiC has certain advantages, such as a closer crystal lattice match to Group III nitrides than other substrates and results in Group III nitride films of high quality. SiC also has a very high thermal conductivity so that the total output power of Group III nitride devices on SiC is not limited by the thermal dissipation of the substrate. Sapphire is another common substrate for Group III nitrides and also has certain advantages, including being lower cost, having established manufacturing processes, and having good light-transmissive optical properties.

Different embodiments of the active LED structure can emit different wavelengths of light depending on the composition of the active layer and n-type and p-type layers. In some embodiments, the active LED structure emits blue light with a peak wavelength range of approximately 430 nanometers (nm) to 480 nm. In other embodiments, the active LED structure emits green light with a peak wavelength range of 500 nm to 570 nm. In other embodiments, the active LED structure emits orange and/or red light with a peak wavelength range of 600 nm to 700 nm. In certain embodiments, the active LED structure may be configured to emit light that is outside the visible spectrum, including one or more portions of the ultraviolet (UV) spectrum, the infrared (IR) or near-IR spectrum. The UV spectrum is typically divided into three wavelength range categories denotated with letters A, B, and C. In this manner, UV-A light is typically defined as a peak wavelength range from 315 nm to 400 nm, UV-B is typically defined as a peak wavelength range from 280 nm to 315 nm, and UV-C is typically defined as a peak wavelength range from 100 nm to 280 nm. UV LEDs are of particular interest for use in applications related to the disinfection of microorganisms in air, water, and surfaces, among others. In other applications, UV LEDs may also be provided with one or more lumiphoric materials to provide LED packages with aggregated emissions having a broad spectrum and improved color quality for visible light applications. Near-IR and/or IR wavelengths for LED structures of the present disclosure may have wavelengths above 700 nm, such as in a range from 700 nm to 1000 nm, or more.

An LED chip can also be covered with one or more lumiphoric materials (also referred to herein as lumiphors), such as phosphors, such that at least some of the light from the LED chip is absorbed by the one or more lumiphors and is converted to one or more different wavelength spectra according to the characteristic emission from the one or more lumiphors. In this regard, at least one lumiphor receiving at least a portion of the light generated by the LED source may re-emit light having different peak wavelength than the LED source. An LED source and one or more lumiphoric materials may be selected such that their combined output results in light with one or more desired characteristics such as color, color point, intensity, etc. In certain embodiments, aggregate emissions of LED chips, optionally in combination with one or more lumiphoric materials, may be arranged to provide cool white, neutral white, or warm white light, such as within a color temperature range of from 2500 Kelvin (K) to 10,000 K. In certain embodiments, lumiphoric materials having cyan, green, amber, yellow, orange, and/or red peak wavelengths may be used. In some embodiments, the combination of the LED chip and the one or more lumiphors (e.g., phosphors) emits a generally white combination of light. The one or more phosphors may include yellow (e.g., YAG:Ce), green (e.g., LuAg:Ce), and red (e.g., $Ca_{1-x-y}Sr_xEu_yAlSiN_3$) emitting phosphors, and combinations thereof.

Lumiphoric materials as described herein may be or include one or more of a phosphor, a scintillator, a lumiphoric ink, a quantum dot material, a day glow tape, and the like. Lumiphoric materials may be provided by any suitable means, for example, direct coating on one or more surfaces of an LED, dispersal in an encapsulant material configured to cover one or more LEDs, and/or coating on one or more optical or support elements (e.g., by powder coating, inkjet printing, or the like). In certain embodiments, lumiphoric materials may be downconverting or upconverting, and combinations of both downconverting and upconverting materials may be provided. In certain embodiments, multiple different (e.g., compositionally different) lumiphoric materials arranged to produce different peak wavelengths may be arranged to receive emissions from one or more LED chips. One or more lumiphoric materials may be provided on one or more portions of an LED chip in various configurations. In certain embodiments, one or more surfaces of LED chips may be conformally coated with one or more lumiphoric materials, while other surfaces of such LED chips may be devoid of lumiphoric material. In certain embodiments, a top surface of an LED chip may include lumiphoric material, while one or more side surfaces of an LED chip may be devoid of lumiphoric material. In certain embodiments, all or substantially all outer surfaces of an LED chip (e.g., other than contact-defining or mounting surfaces) are coated or otherwise covered with one or more lumiphoric materials. In certain embodiments, one or more lumiphoric materials may be arranged on or over one or more surfaces of an LED chip in a substantially uniform manner. In other embodiments, one or more lumiphoric materials may be arranged on or over one or more surfaces of an LED chip in a manner that is non-uniform with respect to one or more of material composition, concentration, and thickness. In certain embodiments, the loading percentage of one or more lumiphoric materials may be varied on or among one or more outer surfaces of an LED chip. In certain embodiments, one or more lumiphoric materials may be patterned on portions of one or more surfaces of an LED chip to include one or more stripes, dots, curves, or polygonal shapes. In certain embodiments, multiple lumiphoric materials may be arranged in different discrete regions or discrete layers on or over an LED chip.

In certain embodiments, one or more lumiphoric materials may be provided as at least a portion of a wavelength conversion element. Wavelength conversion elements may include a support element, such as a superstrate, and one or more lumiphoric materials that are provided by any suitable means, such as by coating a surface of the superstrate or by incorporating within the superstrate. The term "superstrate" as used herein refers to an element placed on or over an LED chip that may include a lumiphoric material. The term "superstrate" is used herein, in part, to avoid confusion with other substrates that may be part of the semiconductor light-emitting device, such as a growth or carrier substrate of the LED chip or a submount of an LED package. The term "superstrate" is not intended to limit the orientation, location, and/or composition of the structure it describes. In some embodiments, the superstrate may be composed of a transparent material, a semi-transparent material, or a light-transmissive material, such as sapphire, SiC, silicone, and/or glass (e.g., borosilicate and/or fused quartz). Superstrates may be formed from a bulk substrate which is optionally patterned and then singulated.

One or more lumiphoric materials may be arranged on the superstrate by, for example, spraying and/or otherwise coating the superstrate with the lumiphoric materials. Wavelength conversion elements may be attached to one or more LED chips using, for example, a layer of transparent adhesive. In other embodiments, wavelength conversion elements may comprise alternative configurations, such as phosphor-in-glass or ceramic phosphor plate arrangements. Phosphor-in-glass or ceramic phosphor plate arrangements may be formed by mixing phosphor particles with glass frit or ceramic materials, pressing the mixture into planar shapes, and firing or sintering the mixture to form a hardened structure that can be cut or separated into individual wavelength conversion elements.

As used herein, a layer or region of a light-emitting device may be considered to be "transparent" when at least 80% of emitted radiation that impinges on the layer or region emerges through the layer or region. Moreover, as used herein, a layer or region of an LED is considered to be "reflective" or embody a "mirror" or a "reflector" when at least 80% of the emitted radiation that impinges on the layer or region is reflected. In some embodiments, the emitted radiation comprises visible light such as blue and/or green LEDs with or without lumiphoric materials. In other embodiments, the emitted radiation may comprise nonvisible light. For example, in the context of GaN-based blue and/or green LEDs, silver (Ag) may be considered a reflective material (e.g., at least 80% reflective). In the case of UV LEDs, appropriate materials may be selected to provide a desired, and in some embodiments high, reflectivity and/or a desired, and in some embodiments low, absorption. In certain embodiments, a "light-transmissive" material may be configured to transmit at least 50% of emitted radiation of a desired wavelength.

The present disclosure can be useful for LED chips having a variety of geometries, such as vertical geometry or lateral geometry. A vertical geometry LED chip typically includes anode and cathode connections on opposing sides or faces of the LED chip. A lateral geometry LED chip typically includes both anode and cathode connections on the same side of the LED chip that is opposite a substrate, such as a growth substrate. In some embodiments, a lateral geometry LED chip may be mounted on a submount of an LED package such that the anode and cathode connections are on a face of the LED chip that is opposite the submount. In this configuration, wirebonds may be used to provide electrical connections with the anode and cathode connections. In other embodiments, a lateral geometry LED chip may be flip-chip mounted on a surface of a submount of an LED package such that the anode and cathode connections are on a face of the active LED structure that is adjacent to the submount. In this configuration, electrical traces or patterns may be provided on the submount for providing electrical connections to the anode and cathode connections of the LED chip. In a flip-chip configuration, the active LED structure is configured between the substrate of the LED chip and the submount for the LED package. Accordingly, light emitted from the active LED structure may pass through the substrate in a desired emission direction. In other embodiments, an active LED structure may be bonded to a carrier submount, and the growth substrate may be removed such that light may exit the active LED structure without passing through the growth substrate.

According to aspects of the present disclosure, LED structures may be incorporated within packages that may include one or more elements, such as lumiphoric materials, encapsulants, light-altering materials, lens, and electrical contacts, among others, that are provided with one or more LED chips. In certain aspects, packages may include a support member, such as a submount or a lead frame. Light-altering materials may be arranged within packages to reflect or otherwise redirect light from the one or more LED chips in a desired emission direction or pattern. As used herein, light-altering materials may include many different materials including light-reflective materials that reflect or redirect light, light-absorbing materials that absorb light, and materials that act as a thixotropic agent. As used herein, the term "light-reflective" refers to materials or particles that reflect, refract, scatter, or otherwise redirect light. For light-reflective materials, the light-altering material may include at least one of fused silica, fumed silica, titanium dioxide ($TiO_2$), or metal particles suspended in a binder, such as silicone or epoxy. In certain aspects, the particles may have an index or refraction that is configured to refract light emissions in a desired direction. In certain aspects light-reflective particles may also be referred to as light-scattering particles. A weight ratio of the light-reflective particles or scattering particles to a binder may comprise a range of about 1:1 to about 2:1. For light-absorbing materials, the light-altering material may include at least one of carbon, silicon, or metal particles suspended in a binder, such as silicone or epoxy. The light-reflective materials and the light-absorbing materials may comprise nanoparticles. In certain embodiments, the light-altering material may comprise a generally white color to reflect and redirect light. In other embodiments, the light-altering material may comprise a generally opaque or black color for absorbing light and increasing contrast. In certain embodiments, the light-altering material includes both light-reflective material and light-absorbing material suspended in a binder.

In certain aspects, the present disclosure is related to high-power LED arrays that are provided on a common submount. Applications for such high-power LED arrays include various color-changing lighting fixtures that may benefit from high precision and dynamic spectral tuning, such as emergency vehicular lighting (e.g., police, ambulance, fire trucks, etc.); multiple color projections of words, images or signs; navigational aids such as lighting for aircraft landing, airport control lighting, nautical buoys and beacons; lighting fixtures for photocatalytic reactions; patterned UV-curing of resins; patterned curing for three-dimensional printing applications; patterned photoresist curing for semiconductor applications; video screen projections; outdoor building lighting; and hand-held light sources such as flashlights and lanterns, among others.

For such high-power applications, LED chips are needed with high output powers. In this regard, LED chips according to the present disclosure may be selected with larger dimensions and/or increased current densities. For example, larger dimensions may include an LED chip having a smallest lateral dimension that is at least 500 microns (μm), or in a range from at least 500 μm to 2000 μm, or in a range from at least 500 μm to 1000 μm, or in a range from at least 1000 μm to 2000 μm. Exemplary LED chip sizes for high-power applications with generally square shapes may include 500 μm by 500 μm, or 1000 μm by 1000 μm, or 2000 μm by 2000 μm with tolerances of + or −10% from any of the above-specified values. In other embodiments, exemplary LED chips may have rectangular shapes with any of the above-specified smallest lateral dimensions and with tolerances of + or −10% from any of the specified values. In other applications, the principles of the present disclosure may be applicable to other LED chip sizes, including smallest lateral dimensions as low as 50 μm, or in a range from 50 μm to any of the above specified larger values, such as 50 μm to 300 um. In such embodiments, smaller chip sizes at or near 50 μm may still be used for high-power applications by arranging multiple ones of the smaller chips together in regions and/or subregions to provide a high-power device. Such chip sizes in high-power applications may be useful for forming pixels for image projection and/or displays. In addition to or in place of LED chip size, high power output LED chips may also include LED chips having higher operating current densities. Actual current density values may be different for various LED types based on what type of epitaxial material systems is used. For example, in the context of nitride-based material systems commonly used for blue LEDs, current densities of greater than or equal to 1 amp per millimeter squared ($A/mm^2$) may be considered high output LED chips.

In order to provide a lighting device with color-changing, dynamic spectral tuning, and the like for high-power applications, high-power light sources having different emission wavelengths may be arranged in close proximity to one another. Conventional lighting devices for such applications may include separately packaged LED components that are clustered together, where each separately packaged LED component may include a single LED chip or a grouping of different LED chips. However, each separately packaged LED component typically includes its own submount and encapsulant, thereby providing spatial limitations in how close the separately packaged LED components may be arranged together.

According to aspects of the present disclosure, high-power LED chips may be arranged together on a common submount to form a tightly packed array or matrix of LED chips. In certain embodiments, a spacing between next-adjacent LED chips of an LED array may be no more than 50%, or no more than 25%, or no more than 10% of a lateral dimension of one or more of the next-adjacent LED chips. With such close spacing, the high-power LED chips may collectively appear as a single light source for any of the above applications. For example, when high-power LED chips having different colors are spaced closely together, aggregated emissions between the different colors may be mixed with improved uniformity. In other applications, closely spaced high-power LED chips having different colors may be selectively activated and deactivated independently of one another to provide the capability of dynamically tuning brightness and/or color of aggregated emissions, or form one or more of images, video displays, signs, shaped lighting emissions for patterned curing, and the like. When the chip spacing of a high-power LED array is so small, challenges exist related to removing heat generated by the LED chips and to providing complex electrical connections for individually controlling the LED chips. According to aspects of the present disclosure, high-power LED arrays may be mounted on a common submount that includes integrated control circuitry. In certain embodiments, the integrated control circuitry may include at least one ASIC that controls the LED array. As used herein, integrated control circuitry such as an ASIC may be configured to provide at least one of: power to the LED chips; a common ground connected to each of the LED chips; logic layers that tie into individual power feeds for each of the LED chips; digital communication signals for selectively activating, deactivating, and/or dimming the LED chips; communication to switching elements for controlling the LED chips. In certain aspects, the integrated control circuitry may be configured to provide dynamic dimming and/or dynamic spectral tuning for the LED chips. For example, in multiple-colored LED arrays, dynamic dimming and/or dynamic spectral tuning may adjust color points and/or brightness levels by way of pulse width modulation signals. Additionally, the common submount may include integrated control circuitry together with various arrangements of thermal structures for heat dissipation.

FIG. 1 is a top view of an exemplary lighting device 10 that includes a plurality of LED chips 12 arranged to form an LED array on a common submount 14 according to principles of the present disclosure. The top view provided in FIG. 1 is of a first face 14' of the submount 14, which corresponds with a primary emission face of the lighting device 10. The LED chips 12 may be provided with a spacing of next-adjacent LED chips as described above to form the LED array. Additionally, the LED chips 12 may embody high-power LED chips with any of the previously described larger dimensions. The lighting device 10 may include a number of contact pads 16 that are arranged to receive power and/or control signals for driving the LED chips 12. The contact pads 16 may include individual pads that are configured as input electrical connections, other individual pads that are configured as output electrical connections, and still other individual pads that are configured to receive control signals and/or logic commands for the LED chips 12. As illustrated, the contact pads 16 may be arranged on the first face 14' and along perimeter edges of the submount 14 in an arrangement that surrounds the LED chips 12. In this manner, spacing between individual ones of the LED chips 12 may be reduced.

The contact pads 16 may be electrically coupled to integrated control circuitry (e.g., an ASIC) that is integrated with the submount 14. For example, a number of electrical interconnects that are incorporated on or within the submount 14 may route power and control signals between the contact pads 16 and the LED chips 12 by way of the integrated control circuitry. For illustrative purposes, FIG. 1 is drawn with two hundred and forty-three LED chips 12 to form the LED array. In other embodiments, the principles of the present disclosure are applicable to any number of LED chips 12 for forming an LED array, such as at least two, or at least four, or at least ten, or at least fifty, or at least one hundred, or in a range with any of the aforementioned values up to one thousand LED chips 12. In still other embodiments, the number of LED chips 12 may exceed one thousand depending on the particular light requirements of an application. In certain embodiments, each of the LED chips 12 may be configured to emit a same wavelength of light. For example, in patterned curing applications, each of the LED chips 12 may be configured to provide UV emissions and the nature of the integrated control circuitry may provide selective activation of certain LED chips 12 of the array that correspond with a desired curing pattern. In other embodiments, different ones of the LED chips 12 may be configured to emit different wavelengths of light, in order to provide multiple-color lighting for various applications.

Figure 2:
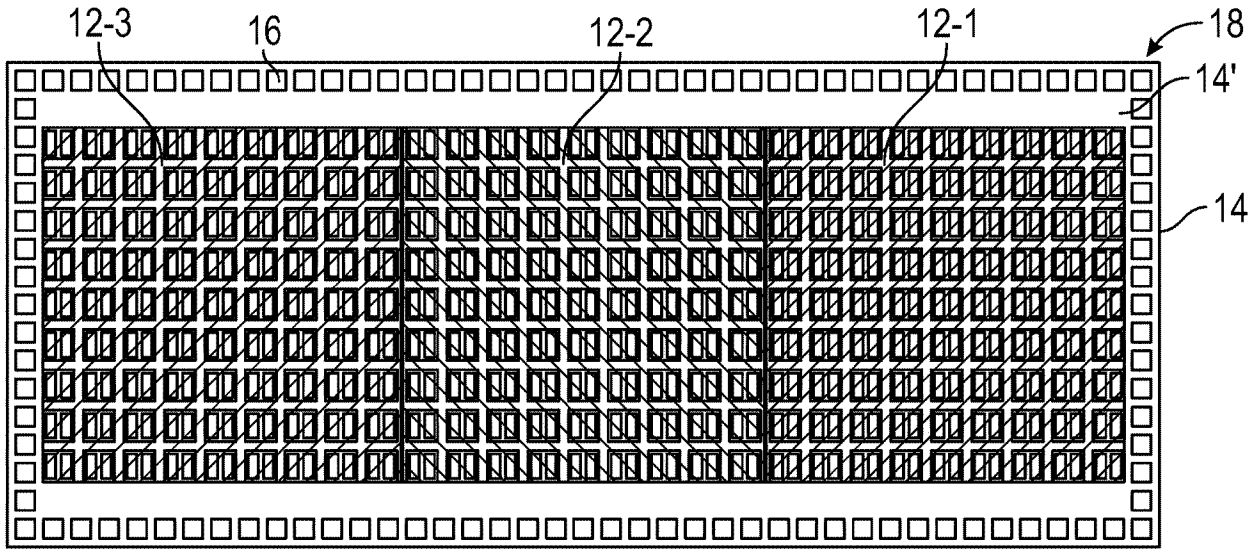
FIG. 2 is a top view of an exemplary lighting device that is similar to the lighting device of FIG. 1 and includes an exemplary layout for multiple-color LED chips where LED chips of the same emission color are grouped together.

FIG. 2 is a top view of an exemplary lighting device 18 that is similar to the lighting device 10 of FIG. 1 and includes an exemplary layout for multiple-color LED chips 12-1 to 12-3 where LED chips of the same emission color are grouped together. In particular, same color LED chips 12-1 to 12-3 may be grouped together along different areas of the submount 14 to form sub-arrays. By way of example, in FIG. 2, a first group of LED chips 12-1 forms a sub-array along the right side of the submount 14, a second group of LED chips 12-2 forms a sub-array along the middle portion of the submount 14, and a third group of LED chips 12-3 forms a sub-array along the left side of the submount 14. As used herein, a group of LED chips includes at least two LED chips according to the present disclosure. As illustrated, the various sub-arrays may be non-overlapping within one another to provide discrete emission areas and to simplify electrical connections to each sub-array. For high power LED applications where viewing distances are typically farther away, such discrete LED sub-arrays may still appear as coming from a single light source.

For multiple-color applications, the first group of LED chips 12-1 may be configured to emit a first peak wavelength of light, the second group of LED chips 12-2 may be configured to emit a second peak wavelength of light, and the third group of LED chips 12-3 may be configured to emit a third peak wavelength of light. In certain embodiments, the first, second, and third peak wavelengths may differ from each other by at least 20 nm. In a specific example, the first group of LED chips 12-1 may embody blue LED chips with a first peak wavelength in a range from 430 nm to 480 nm, the second group of LED chips 12-2 may embody white LED chips with a second peak wavelength in a broad spectrum range that may include, for example a blue LED chip with a broad-spectrum phosphor, and the third group of LED chips 12-3 may embody orange and/or red LED chips with a third peak wavelength in a range from 600 nm to 700 nm. Depending on the epitaxial material type, different ones the LED chips 12-1 to 12-3 with different emission wavelengths may have different forward turn-on voltage values. In certain embodiments, subgroups of the LED chips 12-1 to 12-3 with similar emission wavelengths may share one or more common controls from the contact pads 16, such as a common ground, while still maintaining individual control for each individual LED chip 12-1 to 12-3. By grouping similar LED chips 12-1 to 12-3 together in discrete sub-arrays along different areas of the submount 14, electrical interconnects from the contact pads 16 may be simplified. In the example where the LED chips 12-1 embody blue LED chips and the LED chips 12-2 embody blue LED chips with a phosphor to provide white LED chips, both the LED chips 12-1 and 12-2 may share a common ground.

Figure 3:
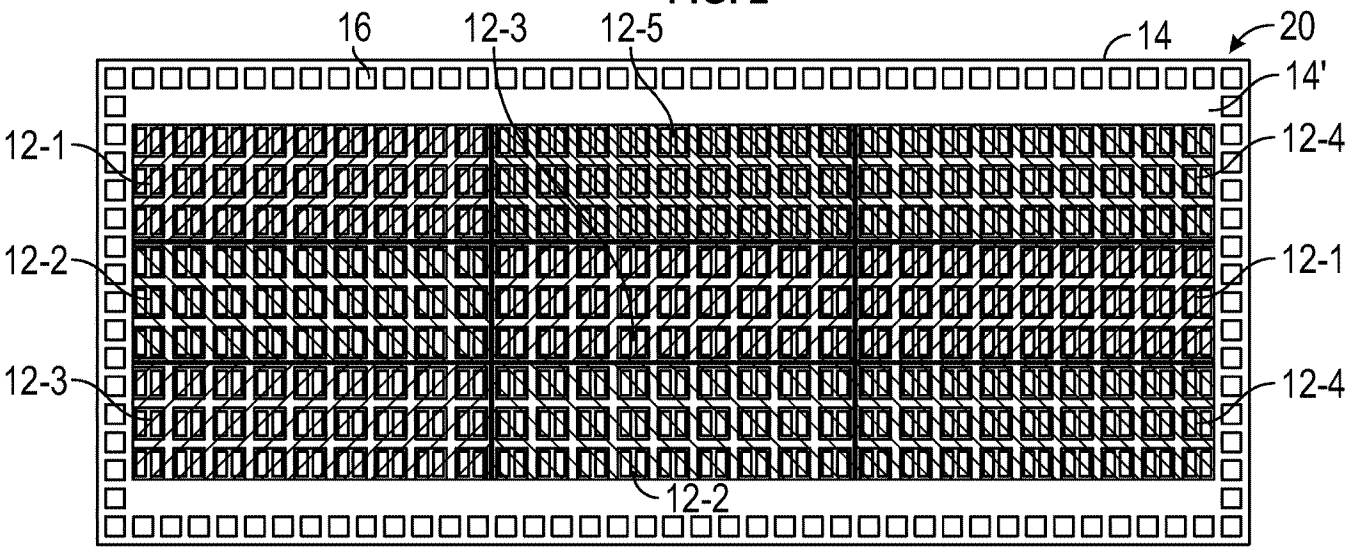
FIG. 3 is a top view of an exemplary lighting device that is similar to the LED device of FIG. 2 and includes another exemplary layout for multiple-color LED chips where LED chips of the same emission color are grouped together.

FIG. 3 is a top view of an exemplary lighting device 20 that is similar to the LED device 18 of FIG. 2 and includes another exemplary layout for multiple-color LED chips 12-1 to 12-5 where LED chips of the same emission color are grouped together to form a plurality of sub-arrays. In FIG. 3, additional groups of LED chips 12-4 and 12-5 providing different peak wavelength emissions are provided on the submount 14. In a specific example, the first group of LED chips 12-1 may embody blue LED chips with a first peak wavelength in a range from 430 nm to 480 nm, the second group of LED chips 12-2 may embody white LED chips with a second peak wavelength in a broad spectrum range, the third group of LED chips 12-3 may embody red LED chips with a third peak wavelength in a range from 630 nm to 700 nm, a fourth group of LED chips 12-4 may embody green LED chips with a fourth peak wavelength in a range from 500 nm to 570 nm, and a fifth group of LED chips 12-5 may embody orange LED chips with a fifth peak wavelength in a range from 600 nm to 630 nm. As with FIG. 2, different groups of same emission color LED chips 12-1 to 12-5 may be arranged together in sub-arrays along different regions of the submount to provide simplified electrical interconnects from the contact pads 16 where same emission color LED chips 12-1 to 12-5 may share one or more common controls while still maintaining individual addressability. As illustrated in FIG. 3, the first group of LED chips 12-1 having the same emission color may be subdivided in different subgroups or sub-arrays that are spaced apart from one another on the submount 14. In certain embodiments, a different common control may be provided for each of the different subgroups of LED chips 12-1. By way of example, a similar configuration is also illustrated for spaced apart subgroups of the LED chips 12-2 to 12-4. The nature of the radially arranged contact pads 16 allows many different configurations of the LED chips 12-1 to 12-5, including one or more additional groups and/or subgroups of emission colors, without deviating from the principles disclosed.

Lighting devices with the above-described LED arrays and integrated control circuitry may provide scalability for various applications. For example, any of the embodiments illustrated in FIGS. 1-3 may be modified so that an overall aspect ratio of the corresponding LED arrays and/or the number of LED chips within the LED arrays is scaled up or down for a particular application. In further embodiments, different combinations of LED chips, with and without lumiphoric materials, may be arranged within each array to provide multiple color emissions while also simplifying required electrical connections. For example, all LED chips within an LED array or all LED chips within a subgroup of the LED array may be arranged with the same epitaxial material type. With the same epitaxial material type, the LED chips of the array or subgroup of the array may have similar turn-on voltages. Accordingly, at least one common control may be shared by each LED chip of the same epitaxial material type while still maintaining separate control for each individual LED chip. This may be accomplished by having a shared electrical connection for either the anode or cathode of each of the LED chips with the same epitaxial material type, while having a separate electrical connection for the other of the anode or cathode of each individual LED chip. The LED chips of the same epitaxial material type may all be configured to emit a same peak wavelength or different ones of the LED chips may be configured to emit different peak wavelengths, depending on the particular epitaxial structure. For example, blue and green emitting LED chips may share a same epitaxial material type (e.g., gallium nitride-based) with different epitaxial structures that respectively provide blue and green emissions. In other examples, all LED chips of a group may emit a same or similar blue peak wavelength, but different ones of the LED chips may be further arranged with different colored lumiphoric materials that provide different colored emissions.

Figure 4:
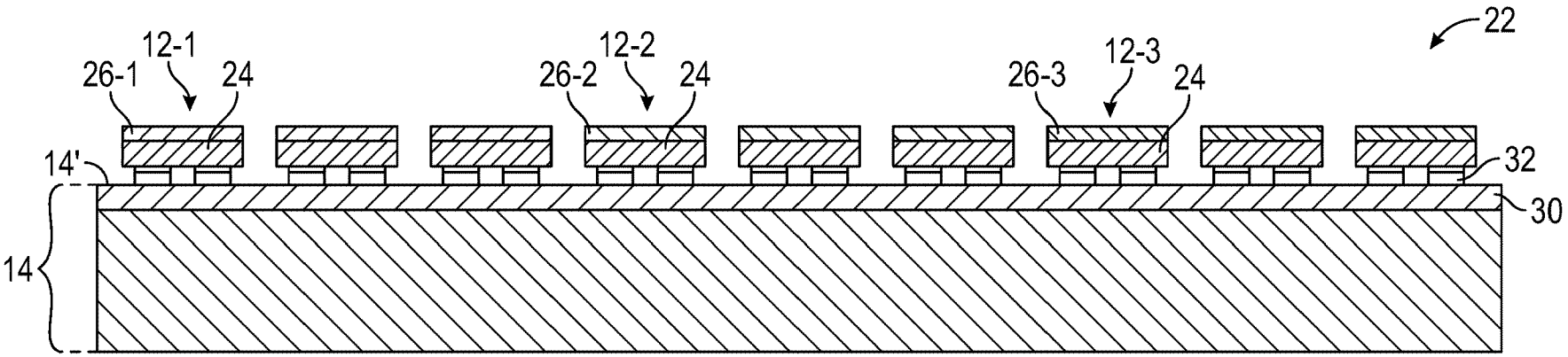
FIG. 4 is a cross-sectional view of a lighting device having a plurality of LED chips that each includes a same epitaxial material type and a same epitaxial structure, where different ones of the LED chips include different colored lumiphoric materials.

FIG. 4 is a cross-sectional view of a lighting device 22 having a plurality of LED chips 12-1 to 12-3 that each include a same epitaxial material type and a same epitaxial structure, where different ones of the LED chips 12-1 to 12-3 include different colored lumiphoric materials. In FIG. 4, each of the LED chips 12-1 to 12-3 includes a same epitaxial structure 24 that includes a same epitaxial material type. The group of LED chips 12-1 further includes a first lumiphoric material 26-1, the group of LED chips 12-2 further includes a second lumiphoric material 26-2, and the group of LED chips 12-3 further includes a third lumiphoric material 26-3, where each of the lumiphoric materials 26-1 to 26-3 may be configured to provide different wavelengths of light conversion from the LED chips 12-1 to 12-3. For example, each of the LED chips 12-1 to 12-3 may be configured to emit blue peak wavelengths, while the first lumiphoric material 26-1 provides converted emissions to red peak wavelengths, the second lumiphoric material 26-2 provides converted emissions to yellow peak wavelengths, and the third lumiphoric material 26-3 provides converted emissions to green peak wavelengths. In this regard, each of the LED chips 12-1 to 12-3 may be individually addressable while sharing at least one common control, and the LED chips 12-1 to 12-3 may be configured to provide multiple-colored emissions for the lighting device 22. In certain embodiments, the lumiphoric materials 26-1 to 26-3 may embody at least one of deposited layers, spray-coated layers, dispensed layer, and preformed structures, such as wavelength conversion components as previously described. The lighting device 22 may further include the submount 14 as previously described. In certain embodiments, the submount 14 may include one or more control circuitry layers 30 that may be provided at or near the first face 14' of the submount 14. The control circuitry layers 30 may embody logic layers, such as one or more logic layers of an ASIC. The LED chips 12-1 to 12-3 may include contacts 32 (i.e., anode and cathode contacts) configured for flip-chip mounting to the submount 14 and/or one or more portions of the control circuitry layers 30.

Figure 5:
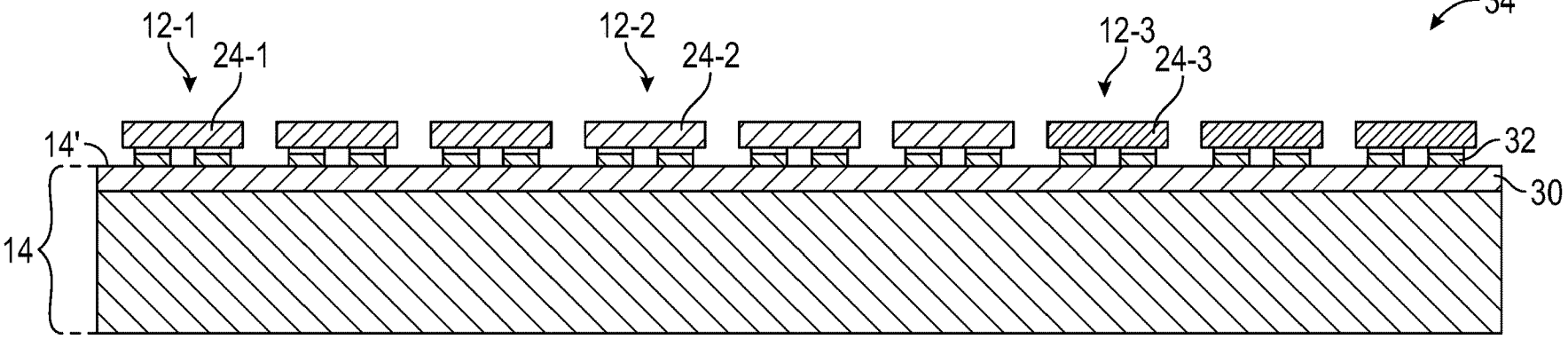
FIG. 5 is a cross-sectional view of a lighting device that is similar to the lighting device of FIG. 4, but where at least one of the LED chips includes a different epitaxial material type than others of the LED chips for providing different wavelengths of light.

FIG. 5 is a cross-sectional view of a lighting device 34 that is similar to the lighting device 22 of FIG. 4, but where at least one of the LED chips 12-1 to 12-3 includes a different epitaxial material type than others of the LED chips 12-1 to 12-3 for providing different wavelengths of light. For example, the LED chips 12-1 may include an epitaxial structure 24-1 configured to emit blue peak wavelengths, the LED chips 12-2 may include an epitaxial structure 24-2 configured to emit red peak wavelengths, and the LED chips 12-3 may include an epitaxial structure 24-3 configured to emit green peak wavelengths. In this regard, each of the LED chips 12-1 may be individually addressable while sharing at least one common control, each of the LED chips 12-2 may be individually addressable while sharing at least one other common control, and each of the LED chips 12-3 may be individually addressable while sharing at least one other common control. In still further embodiments, the LED chips 12-1 and 12-3, while having different epitaxial structures 24-1 and 24-3, may include a same epitaxial material type, thereby allowing LED chips 12-1 and 12-3 to share a common control while still being individually addressable.

Figure 6:
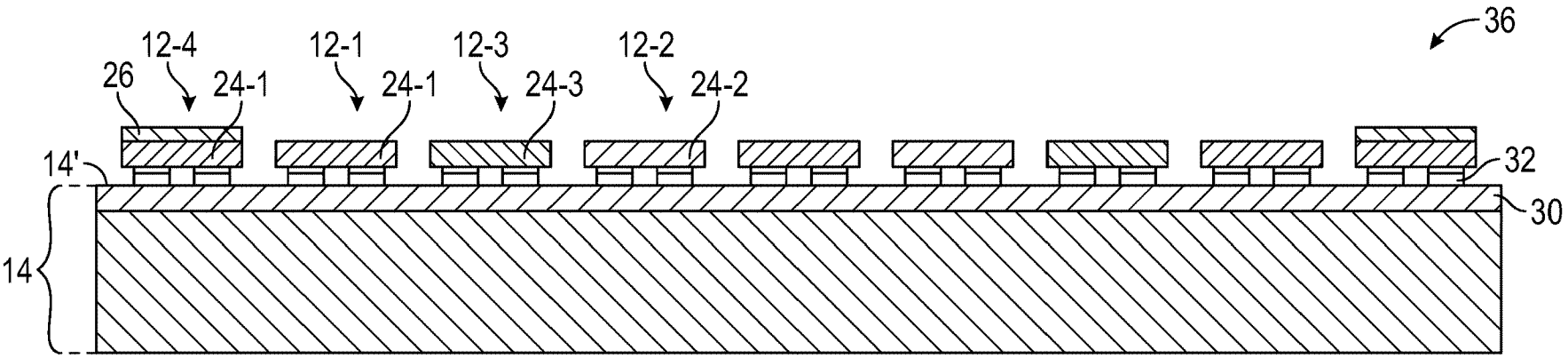
FIG. 6 is a cross-sectional view of a lighting device that is similar to the lighting device of FIG. 5, but where the LED chips embody a combination of arrangements with and without lumiphoric materials for providing different wavelengths of light.

FIG. 6 is a cross-sectional view of a lighting device 36 that is similar to the lighting device 34 of FIG. 5, but where the LED chips 12-1 to 12-4 embody a combination of arrangements with and without lumiphoric materials 26 for providing different wavelengths of light. For example, the LED chips 12-1 to 12-3 may be configured the same as described above for FIG. 5, and the LED chips 12-4 may include the lumiphoric material 26. In certain embodiments, one or more combinations of the LED chips 12-1, 12-3, and 12-4 may comprise epitaxial structures 24-1, 24-3 having a same epitaxial material type for allowing at least one common control. In still further embodiments, the LED chips 12-1 and 12-4 may both have a same epitaxial structure 24-1, while still providing different overall wavelengths of light from one another.

Figure 7:
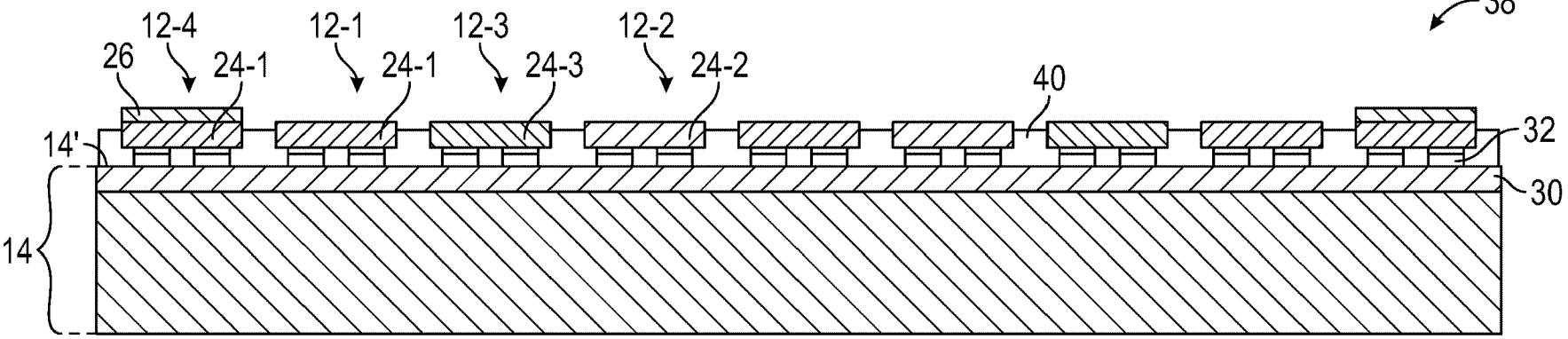
FIG. 7 is a cross-sectional view of a lighting device that is similar to the lighting device of FIG. 6, but further includes at least one light-altering material on the first face of the submount.

FIG. 7 is a cross-sectional view of a lighting device 38 that is similar to the lighting device 36 of FIG. 6, but further includes at least one light-altering material 40 on the first face 14' of the submount 14. The light-altering material 40 may include any of the arrangements described above, including one or more combinations of light-reflective materials that reflect or redirect light, light-absorbing materials that absorb light, and materials that act as a thixotropic agent. The light-altering material 40 may include any of the light-reflective and/or light absorbing particles described above that are incorporated within a binder. As illustrated, the light-altering material 40 may be arranged to cover portions of the first face 14' that are between adjacent ones of the LED chips 12-1 to 12-4 and/or to cover portions of the first face 14' that are between anodes and cathodes (i.e., contacts 32) of individual ones of the LED chips 12-1 to 12-4. In this regard, portions of the light-altering material 40 may be arranged on or even directly on a portion of the control circuitry layers 30. The light-altering material 40 may be arranged to extend to a height above the first face 14' that at least partially covers sidewalls of the LED chips 12-1 to 12-4 or to entirely cover sidewalls of the LED chips 12-1 to 12-4. In embodiments where the light-altering material 40 comprises light-reflective and/or light-refractive particles, such an arrangement may direct laterally emitting light from the LED chips 12-1 to 12-4 toward an intended emission direction above the first face 14'. In still further embodiments, the light-altering material 40 may include light-absorbing particles alone or in combination with light-reflective and/or light-refractive particles for improving contrast between neighboring ones of the LED chips 12-1 to 12-4.

For illustrative purposes, the lighting devices of FIGS. 4-7 are drawn with three or four of each LED chip (12-1 to 12-3 or 12-1 to 12-4); however, the principles disclosed are applicable to any number of the LED chips. Additionally, the principles disclosed are scalable for embodiments that include may different combinations LED chips with and without corresponding lumiphoric materials configured for providing different wavelength emissions, such as four or more different wavelengths or colors, five or more different wavelengths or colors, ten or more different wavelengths or colors, and twenty or more different wavelengths or colors. In certain embodiments, the LED chips may be configured to emit multiple wavelengths within the visible spectrum (e.g., 400 nm to 700 nm) and at least one, or at least two, or at least five wavelengths that are outside the visible spectrum, such as one or more combinations of UV and IR LED chips.

In certain aspects, contact pads for providing external electrical connections and/or control signals may be provided on an opposite face of a common submount than a primary emission face where the LED chips are mounted. By moving the contact pads to the opposite face, the corresponding lighting device may be configured for surface mounting arrangements where electrical connections and/or control signals are concurrently connected as the lighting device is mounted to a larger board and/or lighting fixture. Additionally, the light emitting area of the primary emission face may occupy a larger portion of the primary emission face since the contact pads are on the opposite face. Providing the contact pads on the opposite face can be challenging for such high-power LED arrays, especially high-power LED arrays with large numbers of individually addressable LED chips. For example, routing of individual electrical connections between opposing faces of a submount adds complexity that scales with the total number of LED chips present. In embodiments of the present disclosure, groups of LED chips may be arranged to share common controls and/or electrical connections from certain contact pads, while still maintaining individual control. In certain embodiments, individual control may be provided for groups of LED chips of a common color that share contact pads. In still further embodiments, individual control may be provided for individual LED chips within a larger group of LED chips that share contact pads by providing additional control circuitry that is registered with individual ones of the LED chips. The additional control circuitry may selectively activate and deactivate individual LED chips within a larger group of LED chips that share common contact pads and/or electrical connections.

Figure 8A:
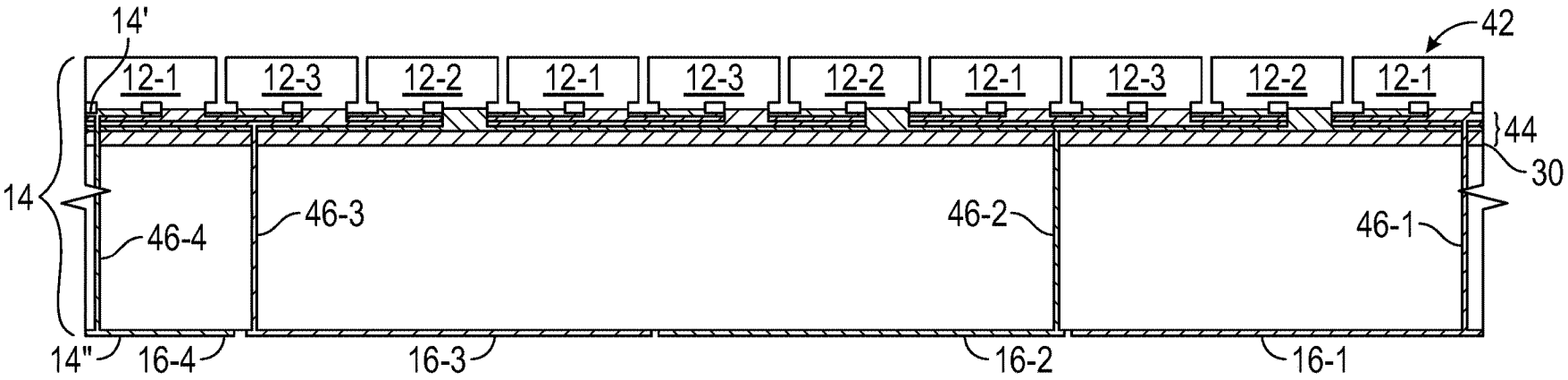
FIG. 8A is a cross-sectional view of a lighting device that is similar to the lighting device of FIG. 4 and further illustrates contact pads that are provided on a second face of the submount, opposite the first face.

FIG. 8A is a cross-sectional view of a lighting device 42 that is similar to the lighting device 22 of FIG. 4 and further illustrates contact pads 16-1 to 16-4 that are provided on a second face 14" of the submount 14, opposite the first face 14'. The second face 14" thereby forms a primary mounting face for the lighting device 42 that is opposite the primary emission face (i.e., the first face 14') of the submount 14. A first contact pad 16-1 is electrically connected to a first group of LED chips 12-1, the second contact pad 16-2 is electrically connected to a second group of LED chips 12-2, and a third contact pad 16-3 is electrically connected to a third group of LED chips 12-3. A fourth contact pad 16-4 is configured as a common connection for all of the LED chips 12-1 to 12-3. In this manner, a signal provided at the fourth contact pad 16-4 and selectively to any of the other contact pads 16-1 to 16-3 may selectively activate any of the groups of LED chips 12-1 to 12-3, independently of one another. The first face 14' of the submount 14 may include various circuit layers 44, that together with a plurality of electrically conductive vias 46-1 to 46-4, provide electrically conductive paths for connecting the LED chips 12-1 to 12-3 to the contact pads 16-1 to 16-4. In this manner, electrical signals are routed through the submount 14 and the circuit layers 44 may embody power distribution layers for the LED chips 12-1 to 12-3. The electrically conductive vias 46-1 to 46-4 may be arranged to entirely extend through the submount 14 between the contact pads 16-1 to 16-4 and the circuit layers 44. In certain embodiments, the circuit layers 44 embody electrically conductive metal traces and/or routing layers that are provided on the submount 14 in a lateral arrangement and/or a stacked arrangement with a number of electrical isolation layers therebetween.

Figure 8B:
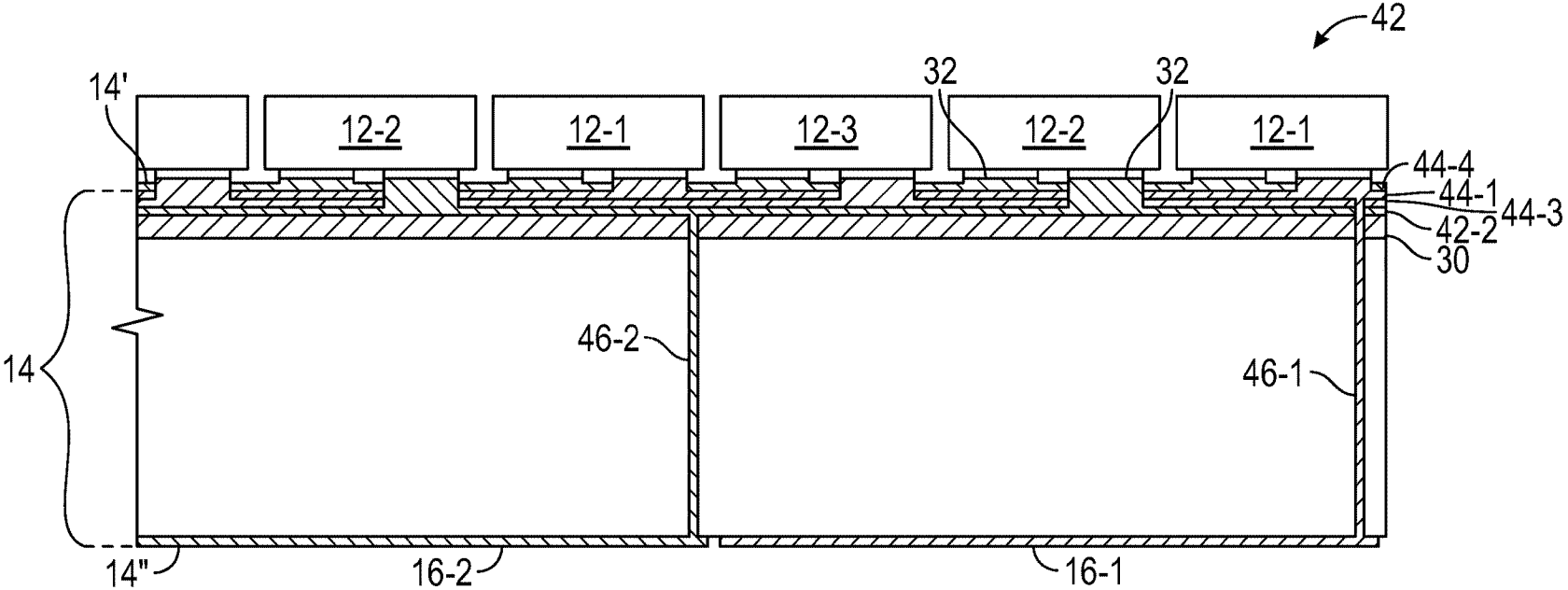
FIG. 8B is an expanded view of a portion of the lighting device of FIG. 8A.

FIG. 8B is an expanded view of a portion of the lighting device 42 of FIG. 8A. As illustrated in FIG. 8B, the circuit layers 44 of FIG. 8A may embody a plurality of circuit layers 44-1 to 44-4 on the first face 14' that are individually coupled to different ones of the contact pads 16-1 to 16-4 by way of the electrically conductive vias 46-1 to 46-4. For illustrative purposes, additional isolation layers that electrically isolate the circuit layers 44-1 to 44-4 from each other are not shown. Each individual one of the circuit layers 44-1 to 44-4 may be electrically coupled to a contact 32 (e.g., the anode or cathode) of a corresponding one or group of the LED chips 12-1 to 12-3. By way of example, the LED chip 12-2 that is the second one from the right in FIG. 8B is arranged with one contact 32 that is electrically connected to the circuit layer 44-2 and another contact 32 that is electrically connected to the circuit layer 44-4.

As described herein, the lighting device 42 as illustrated in FIGS. 8A and 8B may be connected to external electrical connections from the second face 14", thereby allowing the first face 14' (i.e., the primary emission face) to include an increased density of the LED chips 12-1 to 12-3. In certain embodiments, certain ones of the LED chips 12-1 to 12-3 may be aligned at the peripheral edge of the submount 14 or with a spacing that is inset from the peripheral edge of the submount 14 with a distance that is less than or equal to about 50% of a lateral dimension of the LED chips 12-1 to 12-3. As will be later described in greater detail, such an arrangement allows a modular approach where multiple lighting devices 42 may be tiled together to form a larger lighting device while maintaining a uniform spacing for the LED chips 12-1 to 12-3. By positioning the contact pads 16-1 to 16-4 on the second face 14", the contact pads 16-1 to 16-4 may also serve as heat spreaders for the lighting device 42. In certain embodiments, the contact pads 16-1 to 16-4 may extend laterally across the second face 14" such that at least 50%, or at least 75%, or at least 90% of the second face 14" is covered by the contact pads 16-1 to 16-4. Such a configuration may be advantageous when the heat generating LED chips 12-1 to 12-3 are densely packed on the first face 14' as described above. The principles described for FIGS. 8A and 8B are equally applicable to any of the various LED chip and lumiphoric material arrangements described above for FIGS. 2-7.

Figure 9A:
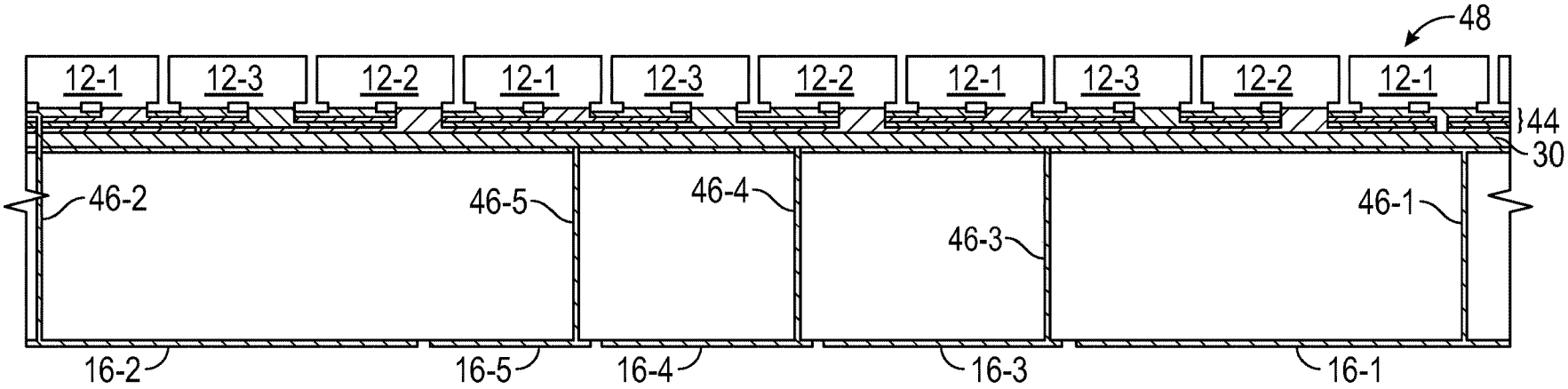
FIG. 9A is a cross-sectional view of a lighting device that is similar to the lighting device of FIG. 8A and further illustrates an arrangement where certain contact pads provide power to all of the LED chips and other contact pads provide data signals for selectively controlling the LED chips.
Figure 9B:
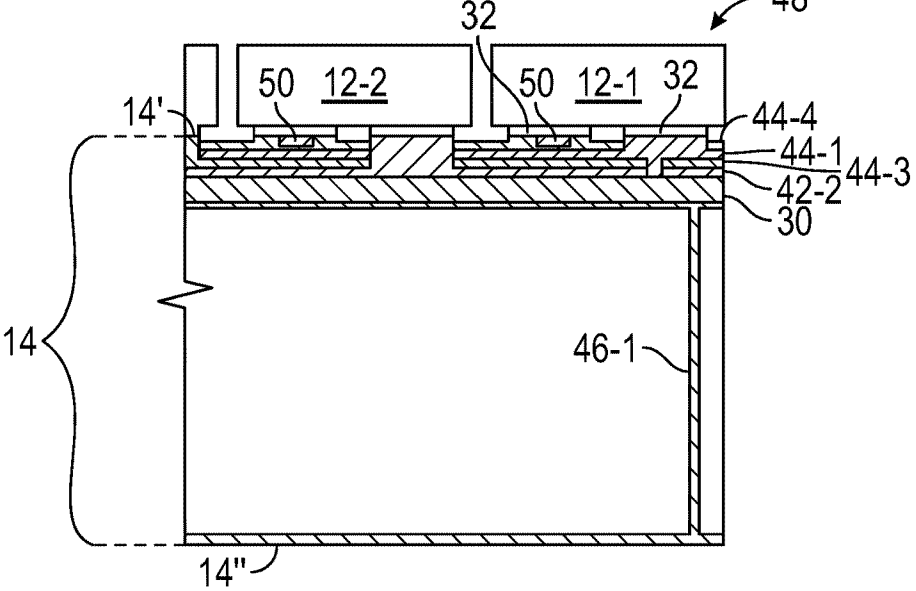
FIG. 9B is an expanded view of a portion of the lighting device of FIG. 9A.

FIG. 9A is a cross-sectional view of a lighting device 48 that is similar to the lighting device 42 of FIG. 8A and further illustrates an arrangement where certain contact pads 16-1, 16-2 provide power signals to all of the LED chips 12-1 to 12-3 and other contact pads 16-3 to 16-5 provide data signals for selectively controlling the LED chips 12-1 to 12-3. FIG. 9B is an expanded view of a portion of the lighting device 48 of FIG. 9A. In certain embodiments, the first contact pad 16-1 and the second contact pad 16-2 may be electrically coupled to the contacts 32 (i.e., the anode and cathode) of all of the LED chips 12-1 to 12-3 by way of the vias 46-1, 46-2. The other contact pads 16-3 to 16-5 may be electrically coupled to the control circuitry layers 30, or ASIC logic layers in certain embodiments, by way of the vias 46-3 to 46-5. In turn, the control circuitry layers 30 may then be coupled to each of the LED chips 12-1 to 12-3. As illustrated in FIG. 9B, a switching device 50 may be provided in the electrical path to at least one of the contacts 32 of the LED chips 12-1 to 12-3. The switching devices 50 for each of the LED chips 12-1 to 12-3 may be associated with the control circuitry layers 30 (e.g., an ASIC) and arranged to receive individual control signals from the control circuitry layers 30 to selectively activate and deactivate individual ones of the LED chips 12-1 to 12-3 in an independent manner. Data signals that are received by the other contact pads 16-3 to 16-5 and processed by the control circuitry layers 30 may provide the commands for independently controlling the switching devices 50. In certain embodiments, the switching devices 50 are registered or vertically aligned with at least one of the contacts 32 of each LED chip 12-1 to 12-3. In this regard, each of the switching devices 50 may be arranged between an individual one of the LED chips 12-1 to 12-3 and other portions of the control circuitry layers 30, for example below the contacts 32 of each LED chip 12-1 to 12-3 and/or below the first face 14' of the submount 14. The switching devices 50 may embody semiconductor transistors, such as field-effect transistors (FETs), metal-oxide-semiconductor field-effect transistors (MOSFETs), and insulated-gate bipolar transistors (IGBTs), among others. In certain embodiments, the control circuitry layers 30 (e.g., an ASIC) may be configured to control gates of the switching devices 50 during operation. The principles described for FIGS. 9A and 9B are equally applicable to any of the various LED chip and lumiphoric material arrangements described above for FIGS. 2-7 and modular configurations described for FIGS. 8A and 8B.

Figure 10A:
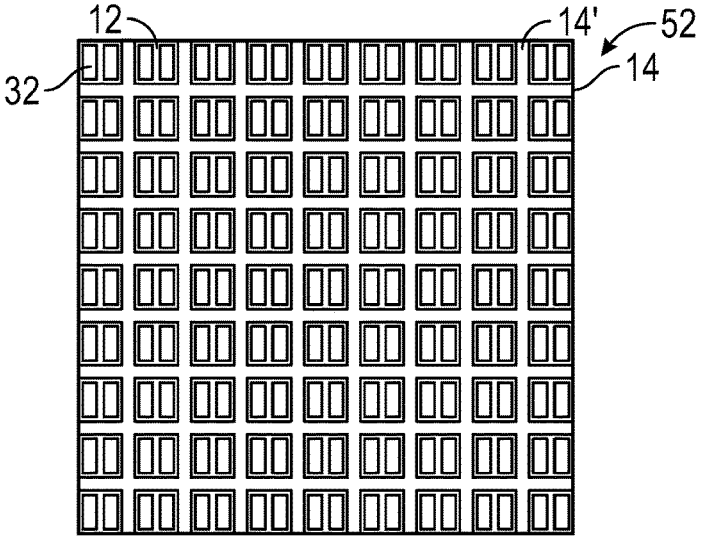
FIG. 10A is top view of a lighting device that may be arranged accordingly to any previously described embodiments.
Figure 10B:
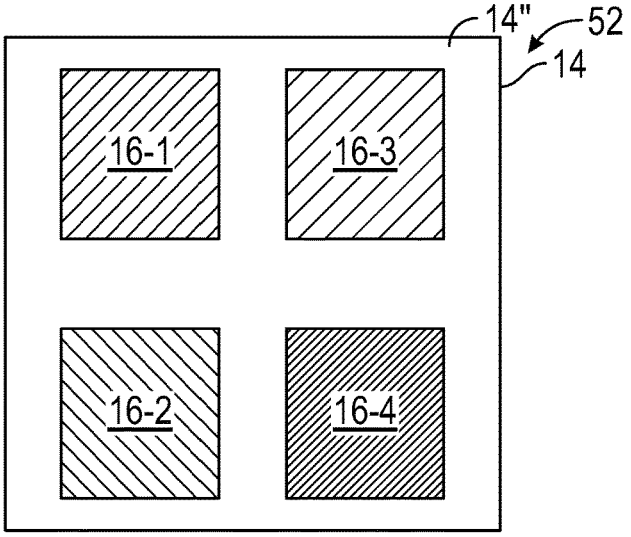
FIG. 10B is a bottom view of the lighting device of FIG. 10A.
Figure 10C:
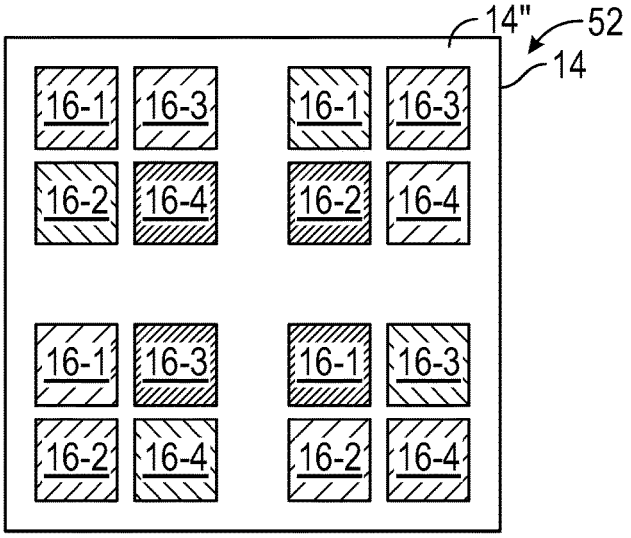
FIG. 10C is an alternative bottom view of the lighting device of FIG. 10A where multiple sets of contact pads may be provided to individually activate and deactivate each of the LED chips visible in FIG. 10A.

FIG. 10A is top view of a lighting device 52 that may be arranged accordingly to any previously described embodiments. The view provided in FIG. 10A is from the first face 14' of the submount 14, also referred herein as the primary emission face. A plurality of LED chips 12 is mounted to the first face 14'. For illustrative purposes, locations of the contacts 32 for each of the LED chips 12 are visible in FIG. 10A. This illustrates respective locations where the LED chips 12 are mounted and electrically connected to corresponding portions of the submount 14. FIG. 10B is a bottom view of the lighting device 52 of FIG. 10A. The view provided in FIG. 10B is from the second face 14" of the submount 14, also referred herein as the primary mounting face for the lighting device 52. As illustrated, the contact pads 16-1 to 16-4 are arranged on the second face 14" and a single set of the contact pads 16-1 to 16-4 may be provided to individually activate and deactivate each of the LED chips 12 visible in FIG. 10A. FIG. 10C is an alternative bottom view of the lighting device 52 of FIG. 10A where multiple sets of contact pads 16-1 to 16-4 may be provided to individually activate and deactivate each of the LED chips 12 visible in FIG. 10A. In such an arrangement, different sets of the contact pads 16-1 to 16-4 may be configured to configure one or more groups or subgroups of the LED chips 12 of FIG. 10A. In FIGS. 10B and 10C, the contact pads 16-1 to 16-4 may embody either of the configurations described above for FIGS. 8A-8B and FIGS. 9A-9B.

Figure 11:
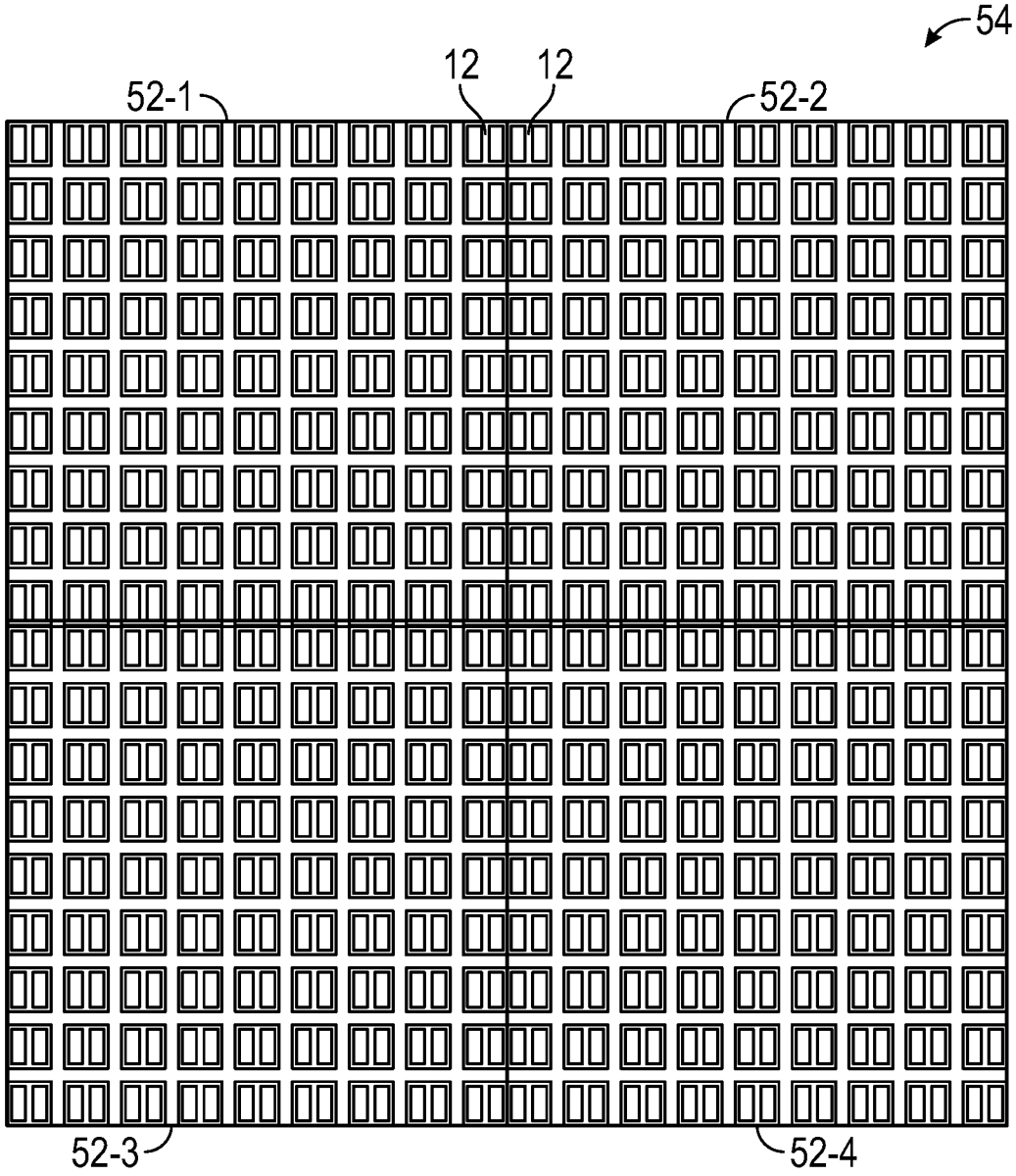
FIG. 11 is top view of a larger lighting device that may be formed by arranging multiple ones of the lighting device of FIG. 10A together.

As previously described, embodiments of the present disclosure may be suitable for modular applications where multiple devices are tiled together to form a larger lighting device and/or display. In this regard, FIG. 11 is top view of a larger lighting device 54 that may be formed by arranging multiple lighting devices 52 of FIG. 10A together. As illustrated, multiple lighting devices 52-1 to 52-4 may be arranged together at one or more respective lateral edges to assemble the larger lighting device 54. By providing the contact pads on opposite sides or faces of the lighting devices 52-1 to 52-4 from which the LED chips 12 are mounted, the primary emission face of the lighting device 54 may be more densely populated with the LED chips 12. Additionally, spacing between neighboring LED chips 12 may be maintained across each of the multiple lighting devices 52-1 to 52-4 that form the larger lighting device 54.

According to principles of the present disclosure, the arrangement of the LED arrays on a common substrate with control circuitry and/or logic may provide numerous advantages for associated lighting devices, including dynamically tunable color points with greater control over tuning, increased luminous output per color target, and greater spectral tuning from multicolor arrangements. By incorporating control circuitry within the common submount, for example within the ASIC of a common submount, fewer electrical interconnects are needed, thereby allowing increased density of LED chips within the array. Lighting devices as disclosed herein may provide full digital control versus, as opposed to just analog control, and may further enable dynamic spectral tuning from external inputs, such as one or more of time, luminous intensity, and color shifting.

It is contemplated that any of the foregoing aspects, and/or various separate aspects and features as described herein, may be combined for additional advantage. Any of the various embodiments as disclosed herein may be combined with one or more other disclosed embodiments unless indicated to the contrary herein.

Those skilled in the art will recognize improvements and modifications to the preferred embodiments of the present disclosure. All such improvements and modifications are considered within the scope of the concepts disclosed herein and the claims that follow.

What is claimed is:

1. A lighting device comprising:

a submount comprising a primary emission face, a primary mounting face that is opposite the primary emission face, and an application-specific integrated circuit (ASIC); and a plurality of LED chips on the primary emission face, wherein the ASIC is arranged between the plurality of LED chips and the primary mounting face, and the ASIC is configured to provide control signals to the plurality of LED chips;

wherein the plurality of LED chips comprises a first group of LED chips configured to provide a first peak wavelength, a second group of LED chips configured to provide a second peak wavelength that is different than the first peak wavelength, and a third group of LED chips configured to provide a third peak wavelength that is different than both the first peak wavelength and the second peak wavelength; and wherein each of the first group of LED chips, the second group of LED chips, and the third group of LED chips forms discrete sub-arrays on the submount.

2. The lighting device of claim 1, further comprising a plurality of contact pads that is arranged to receive external electrical connections.

3. The lighting device of claim 2, wherein the plurality of contact pads is arranged on the primary emission face.

4. The lighting device of claim 2, wherein the plurality of contact pads is arranged on the primary mounting face.

5. The lighting device of claim 4, wherein the plurality of contact pads is arranged to cover at least 75% of the primary mounting face.

6. The lighting device of claim 4, further comprising a plurality of electrically conductive vias that is provided between the plurality of contact pads and the primary emission face.

7. The lighting device of claim 2, wherein the plurality of contact pads comprises:

a first contact pad that is electrically coupled to the first group of LED chips;

a second contact pad that is electrically coupled to the second group of LED chips;

a third contact pad that is electrically coupled to the third group of LED chips; and a fourth contact pad that is electrically coupled to each of the first, second, and third groups of LED chips.

8. The lighting device of claim 2, wherein the plurality of contact pads comprises:

a first contact pad that is electrically coupled to provide power signals to each of the first, second, and third groups of LED chips;

a second contact pad that is electrically coupled to provide power signals to each of the first, second, and third groups of LED chips; and one or more additional contact pads that are configured to receive data signals for the ASIC.

9. The lighting device of claim 1, further comprising a plurality of circuit layers that provides electrical connections between the ASIC and the plurality of LED chips at the primary emission face.

10. The lighting device of claim 9, further comprising a light-altering material that is on the plurality of circuit layers, wherein the light-altering material is arranged to extend to a height that at least partially covers sidewalls of the plurality of LED chips.

11. The lighting device of claim 9, further comprising a plurality of switching devices that is configured to selectively activate and deactivate individual LED chips of the plurality of LED chips.

12. The lighting device of claim 1, wherein the ASIC is configured to provide signals for selectively dimming individual ones of the plurality of LED chips.

13. The lighting device of claim 1, wherein the first peak wavelength, the second peak wavelength, and the third peak wavelength differ from one another by at least 20 nanometers (nm).

14. The lighting device of claim 1, wherein each LED chip of the plurality of LED chips comprises a same epitaxial material type, and one or more of the first group of LED chips, the second group of LED chips, and the third group of LED chips further comprises a lumiphoric material.

15. The lighting device of claim 1, wherein at least one of the first group of LED chips, the second group of LED chips, and the third group of LED chips comprises a different epitaxial material type than others of the first group of LED chips, the second group of LED chips, and the third group of LED chips.

16. The lighting device of claim 1, wherein a lateral dimension of each LED chip of the plurality of LED chips is in a range from 500 microns (μm) to 2000 μm.

17. The lighting device of claim 1, wherein a lateral dimension of each LED chip of the plurality of LED chips is in a range from 50 μm to 300 μm.

18. A lighting device comprising:

a submount comprising a primary emission face, a primary mounting face that is opposite the primary emission face, and an application-specific integrated circuit (ASIC);

a plurality of LED chips on the primary emission face, wherein the ASIC is arranged between the plurality of LED chips and the primary mounting face, and the ASIC is configured to provide control signals to the plurality of LED chips; and a plurality of switching devices that is associated with the ASIC, wherein the plurality of switching devices is arranged below the primary emission face of the submount, wherein individual switching devices of the plurality of switching devices are configured to selectively activate and deactivate individual LED chips of the plurality of LED chips.

19. The lighting device of claim 18, wherein each switching device of the plurality of switching devices is registered with an individual LED chip of the plurality of LED chips.

20. The lighting device of claim 18, further comprising:

a first contact pad that is electrically coupled to provide power signals to each of the first, second, and third groups of LED chips;

a second contact pad that is electrically coupled to provide power signals to each of the first, second, and third groups of LED chips; and one or more additional contact pads that are configured to receive data signals for the ASIC.

21. The lighting device of claim 20, wherein at least a portion of the data signals controls operation of the plurality of switching devices.

22. The lighting device of claim 20, wherein the first contact pad, the second contact pad, and the one or more additional contact pads are arranged on the primary mounting face.

23. The lighting device of claim 18, wherein the plurality of LED chips comprises:

a first group of LED chips configured to provide a first peak wavelength;

a second group of LED chips configured to provide a second peak wavelength that is different than the first peak wavelength; and a third group of LED chips configured to provide a third peak wavelength that is different than both the first peak wavelength and the second peak wavelength;

wherein each of the first group of LED chips, the second group of LED chips, and the third group of LED chips forms discrete sub-arrays on the submount.

24. The lighting device of claim 18, wherein the plurality of switching devices comprises at least one of a field-effect transistor (FET), a metal-oxide-semiconductor field-effect transistor (MOSFET), and an insulated-gate bipolar transistor (IGBT).

* * * * *